United States Patent [19]

Steidle-Sailer et al.

[11] Patent Number: 4,525,974

[45] Date of Patent: Jul. 2, 1985

[54] WOOD BEAM

[75] Inventors: Manfred Steidle-Sailer, Sigmaringen; Matthias Andres, Beuren, both of Fed. Rep. of Germany

[73] Assignee: Emil Steidle GmbH & Co., Fed. Rep. of Germany

[21] Appl. No.: 317,744

[22] Filed: Nov. 3, 1981

[30] Foreign Application Priority Data

Nov. 3, 1980 [DE] Fed. Rep. of Germany ..... 3041370

[51] Int. Cl.[3] ..... E04C 3/02

[52] U.S. Cl. ..... 52/693; 52/643; 52/726; 52/729; 52/127.7; 403/287

[58] Field of Search ..... 52/694, 726, 729, 127.7, 52/127.12, 586, 643, 693; 403/8, 260, 287, 294

[56] References Cited

U.S. PATENT DOCUMENTS

| | | | |
|---|---|---|---|
| 571,042 | 11/1896 | Edquist | 403/8 |
| 2,055,701 | 9/1936 | Palmer | 52/694 |
| 2,169,253 | 11/1939 | Kotrbaty | 52/693 |
| 2,654,923 | 10/1953 | Johnson | 403/8 |
| 3,170,198 | 2/1965 | Snider | 52/693 |
| 3,748,809 | 7/1973 | Jackson | 52/693 |
| 3,861,109 | 1/1975 | Hunt et al. | 52/693 |
| 4,007,507 | 2/1977 | Hansen | 52/726 X |
| 4,074,498 | 2/1978 | Keller et al. | 52/729 X |
| 4,109,429 | 8/1978 | Whisson | 52/127.12 X |
| 4,159,758 | 7/1979 | Courson | 52/726 X |
| 4,299,067 | 11/1981 | Bertschi | 52/127.12 |

FOREIGN PATENT DOCUMENTS

| | | | |
|---|---|---|---|
| 2907746 | 9/1979 | Fed. Rep. of Germany | 52/694 |
| 882912 | 11/1961 | United Kingdom | 52/694 |

*Primary Examiner*—Henry E. Raduazo
*Assistant Examiner*—Naoko N. Slack
*Attorney, Agent, or Firm*—Ostrolenk, Faber, Gerb & Soffen

[57] ABSTRACT

A supporting beam includes a first and second parallel spaced apart flange. A lattice web holds the two flanges apart. At one end of the flanges, there is a solid web of wood. The butt end of the solid web has a recess which is profiled for receiving an adapter section. The recess may be triangular or semi-circular or flat walled. The adapter section is symmetric with one half in and the other half projecting out of a recess. When two butt ends of two solid webs are overlain, the respective recesses overlie and an adapter section is disposed in the overlaying recesses. The adapter section and the recesses both extend transversely of the direction between the flanges and fully across the solid web. The abutting solid webs of two beams define a single beam assembly. Respective brackets behind each of the solid webs are clamped together for pushing the solid webs together. In an array of a plurality of the beam assemblies, the brackets may extend across the parallel solid webs of a number of the beam assemblies. Various other clamping arrangements for clamping together the solid webs of two beams of a beam assembly are disclosed, including a screw connection arrangement.

19 Claims, 19 Drawing Figures

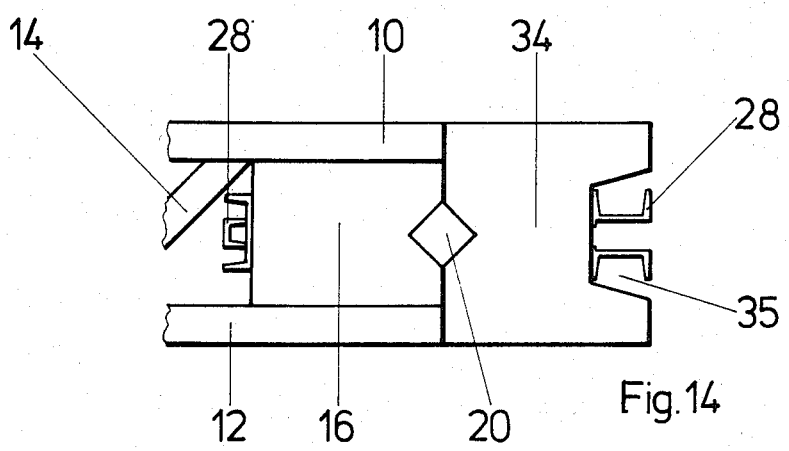
Fig. 14
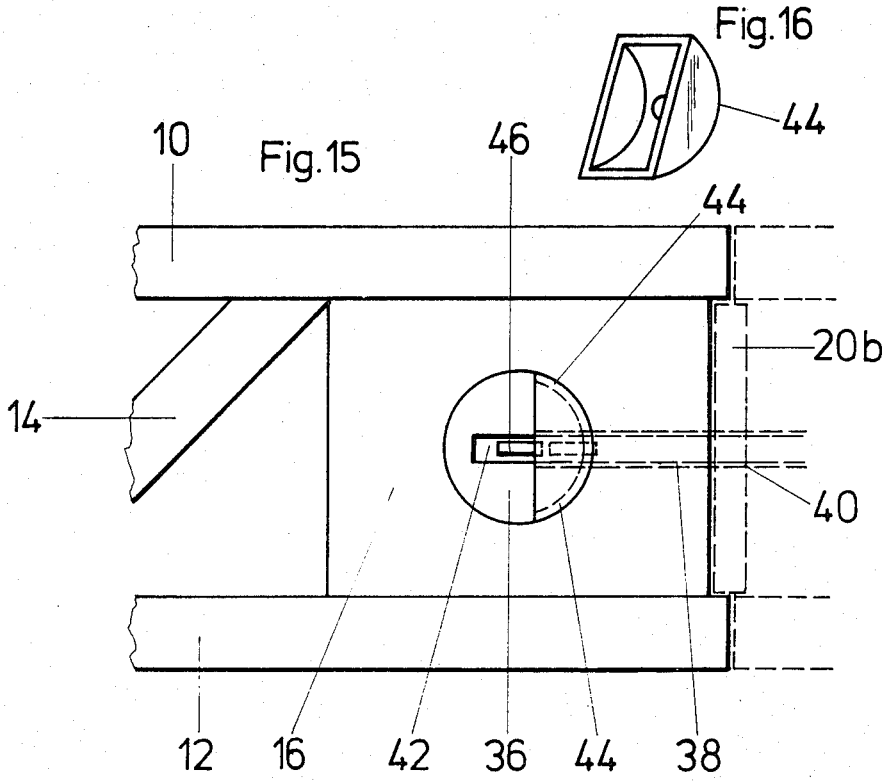

WOOD BEAM

BACKGROUND OF THE INVENTION

This invention concerns a wooden beam used extensively, especially when in the form of lattice beams, as sheathing in poured-concrete construction. More specifically it concerns wooden beams with elements that consist of large-surfaced sheathing panels the backs of which are strengthened with several parallel steel flanges and to which a large number of parallel wooden lattice beams are anchored to provide the panels with the requisite stiffness. These large-surfaced sheathing elements are light in weight and easy to nail and clean. Problems arise however from the necessity of having sheathing panels of various size available. This demand is encountered especially with wall sheathing because contemporary construction often calls for stories of different height, which requires changing the height of the sheathing. To satisfy this requirement for sheathing elements of different height, the wooden lattice beams that are used with them are delivered in different lengths, for example, in ten different lengths ranging from 2.56 to 6 m. This means that a large assortment of beams must be kept in stock for the appropriate length to be readily available.

To decrease the number of various beam lengths that must be kept in stock, adjustable beams are known. German Patent No. 1 147 018 discloses one example. The length of the sheathing beams specified in that document are adjustable and consist of two wooden lattice beams that slide together inside bands that can be braced against the beams with wedges. These beams have proved to be excellent, although they have the drawback of overlapping, which adds the thickness of one beam (approximately 10 cm) at the point of overlap and makes the surface to be sheathed uneven.

Joining beams of various lengths together, especially into overlength beams of 10 to 15 m, with dovetail joints is also known. These overlength beams are intended to be taken apart at the joint later by the customer when shorter beams are required. In practice, however, they are usually not taken apart but are kept unseparated at the yard, which complicates the storage problem.

SUMMARY OF THE INVENTION

The purpose of the present invention is to create wooden beams that can be axially lengthened without buckling and can be used to make sheathing elements of different heights.

This purpose is achieved in accordance with the invention by providing recesses in the butt ends of solid webs which extend between the flanges at the ends of the beams, the recesses receiving adapter sections that transmit lateral forces. Braces, which acts in a direction parallel to the beams and are used to clamp abutting beams together, can be anchored to the solid web. The invention makes it possible to make the beams of any desired length without buckling and with sufficient bending strength at the joint that sheathing panels can be picked up and laid down with a crane without the risk of break or deformation. The reinforcement provided at the ends by the solid webbing will ensure great strength at the joint as well as secure anchorage for the braces, which will be clamped together by threaded bolts or wedge taper mechanisms to provide an unbendable joint, with the adapter sections guaranteeing high transmission of lateral forces. Such forces occur for example to a great extent at right angles to the sheathing skin at the joints of sheathing beams or elements as the result of the shearing force generated by the weight of the concrete.

To distribute these forces sufficiently it is important to align and shape the adapter sections and adapter recesses correctly to ensure that the beams are vertically centered when the braces are applied.

In several embodiments of the invention the adapter sections may be extended through the width of a beam to compensate for the slight lateral displacements in the beam that can occur in sheathing.

It is also possible for the adapter sections to be rods or tubes that extend all the way through the beam when the joints are all at the same height. The braces can involve transverse pieces that rest against the back of the solid webs that reinforce the ends of the beam. The braces can also instead be anchored in recesses in the solid webs with appropriate stops.

The wooden beam in accordance with the invention is in particular designed in the form of a lattice beam with each pair of flange struts providing one node division and half of each node division corresponding to a grid field forming a unit of length that is the modulus for the lengths of the adjustable beam.

To compensate for slight differences in length the invention provides for extenders that are exactly one modulus long and that can be applied and clamped instead of another bearer to one end of a bearer.

BRIEF DESCRIPTION OF THE DRAWINGS

Some examples of embodiments of the invention will now be specified with reference to the drawing, in which FIG. 14 is a view of the end of a lattice beam with an extender, FIG. 15 is a view of the end of a beam with a cup-shaped fastener in the recess in the solid web at the end that serves as a stop for the brace, FIG. 16 is a perspective view of the cup-shaped fastener itself.

DETAILED DESCRIPTION OF THE PREFERRED EMBODIMENTS

Figure 5:
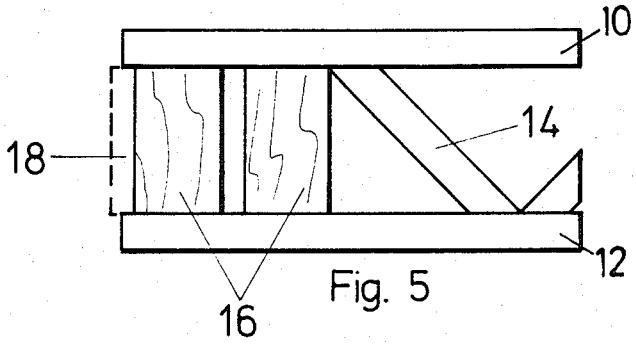
FIGS. 1, 3, and 5 are side views of the end of wooden lattice beams with various types of end reinforcements.
Figure 6:
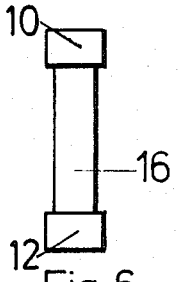
FIGS. 2, 4, and 6 are end views of the beams in FIGS. 1, 3, and 5 respectively.
Figure 3:
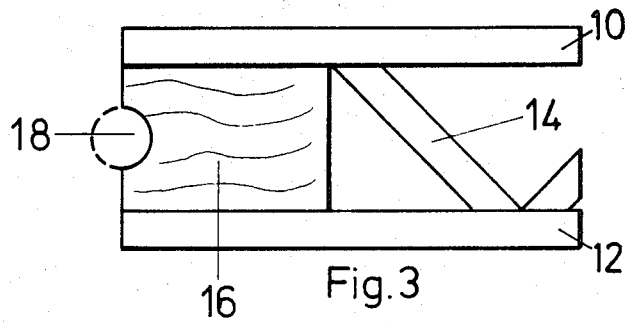
Figure 4:
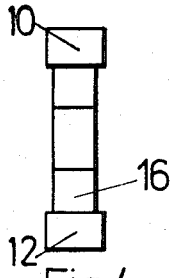
Figure 1:
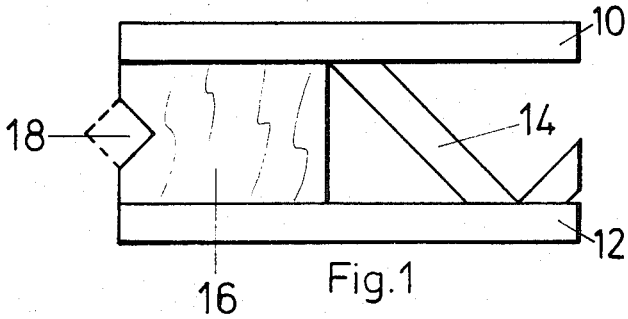
Figure 2:
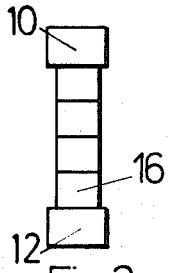

Referring to FIGS. 1 through 6 the bearer in the drawings is a lattice beam with a first flange 10, a second flange 12, and struts 14 that are glued into grooves in the flanges. Solid beams with appropriate recesses for the braces can also be employed. The lattice beam is designed in the form of a grid beam, with the fields formed by the diagonal webs being 32 cm long with the beam being 36 cm high. The flanges are approximately 10 mm wide. The last field at each end of the beam has a solid web 16 that, as is evident from FIGS. 2, 4, and 6, is almost as wide as top flange 10 and bottom flange 12. Solid web 16 is dovetailed into the top and bottom flanges. It can consist of two or more pieces of solid wood or glued boards. In the embodiment illustrated in FIG. 5, a space can be left between two sections of the web when pieces of solid wood with standard cross-sections of 7×14 cm are employed (in which case the dimensions of the space will depend on the dimensions of the grid modulus).

Figure 13:
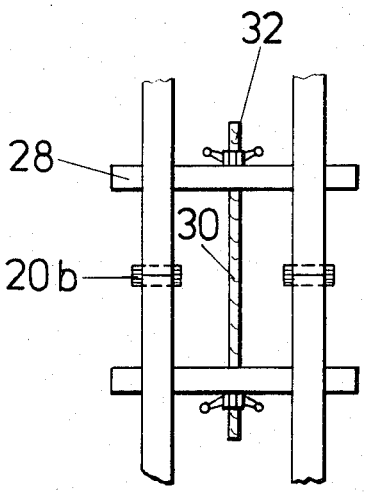
FIG. 13 is a view of the lattice beams in FIG. 12 rotated 90° around their common axis.
Figure 12:
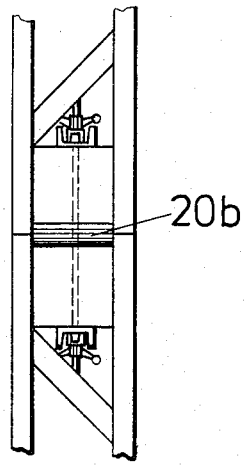
FIG. 12 is a view similiar to FIG. 7 of two lattice beams butted and bolted together but with plate-type adapter sections to transmit lateral forces.
Figure 10:
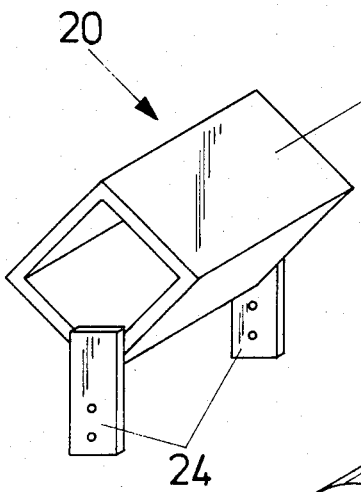
FIG. 10 is a perspective view of an adapter section that can be placed between two end reinforcements to transmit lateral forces.
Figure 11:
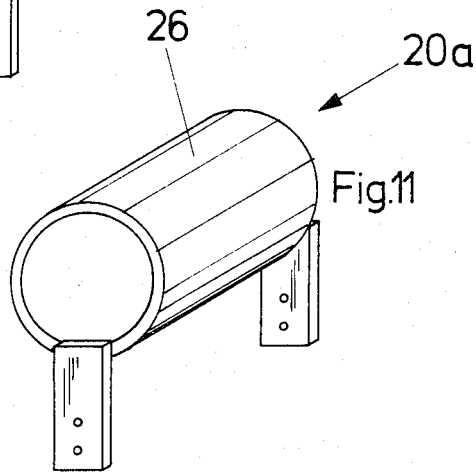
FIG. 11 is a perspective view of a differently shaped adapter section.

Solid web 16 has an adapter recess 18 in its butt end. The recess in the embodiment illustrated in FIGS. 1 and 2 is triangular, that in the embodiment in FIGS. 3 and 4 semicircular, and that in FIGS. 5 and 6 is rectangular formed by recessing the web as a whole toward the middle of the beam. Adapter sections 20 such as those shown for example in FIGS. 10 and 11 are inserted in the openings formed by the adapter recesses at the abutting ends of two abutting beams to transmit the lateral force. FIG. 10 shows the preferred mode of employing adapter section 20. This mode is employed as illustrated in FIGS. 1, 2, 7, 8, 9, and 14. Adapter section 20 consists of a tube 22 with a square cross-section and with brackets 24 welded to its ends. The adapter section can be nailed through brackets 24 to solid web 16 of one of the abutting beams, as shown in FIG. 9. Adapter section 20*a* consists of a tube 26 with a circular cross-section that fits into the semicircular adapter recesses 18 illustrated in FIG. 3. Adapter section 20*b*, which is used with the type of beam illustrated in FIG. 5, is illustrated in FIGS. 12, 13, and 15. As FIG. 13 shows, adapter section 20*b* consists of several layers of plates that are as long as the width of the web and a little wider than the flange to ensure lateral-force transmission even when the beams do not abut laterally with perfect precision. Instead of an adapter section, solid web 16 at the end of the beam can, as illustrated by the dashed lines in FIG. 5, project from the end of the beam in such a way as to fit into the adapter recess in the abutting beam, although this system has the drawback that the beams can only be extended in one direction.

The abutting beams are clamped together with braces. These braces consist of transverse sections 28, threaded bolts 30, and nuts 32. When two neighboring pairs of abutting bearers are to be clamped together, as is normally the case, a transverse section 28 is placed across the backs of each abutting solid web, a threaded bolt 30 is inserted through a hole in each section on the axis between each pair of beams, and nuts 32 are screwed onto each end of the bolt and tightened to hold the transverse sections tightly against the backs of the solid webs. Transverse sections 28 can also be used to brace more than two pairs of abutting beams, in which case it is practical to employ one threaded bolt 30 between each two pairs of abutting beams. In special cases, when only one pair of abutting bearers is to be clamped together, the transverse sections will have a hole at each end and there will be a bolt on each side of the pair to ensure an evenly distributed clamping force. These braces will clamp two abutting beams securely together and also hold neighboring pairs of beams securely in place. The adapter sections will automatically position the butt ends accurately and will transmit lateral forces so that sheathing panels or the like can be applied to the parallel lattice beams without collapsing.

Although the adapter sections that accept the lateral force in the embodiments illustrated in FIGS. 10 and 11 are sections of metal tubing, appropriately shaped wooden adapters can also be used.

Figure 8:
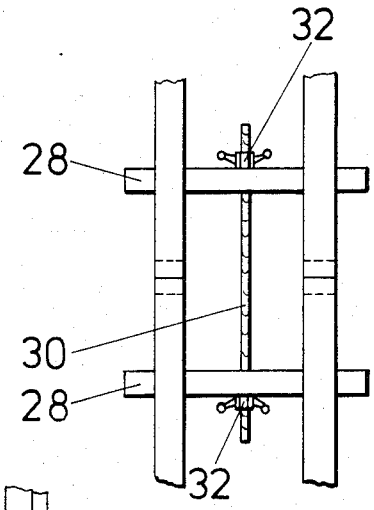
FIG. 8 is a view of the lattice beams in FIG. 7 rotated 90° around their common axis.
Figure 7:
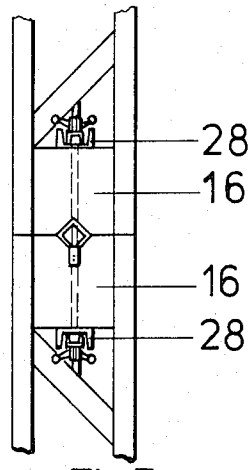
FIG. 7 is a side view of two lattice beams butted and bolted together.
Figure 9:
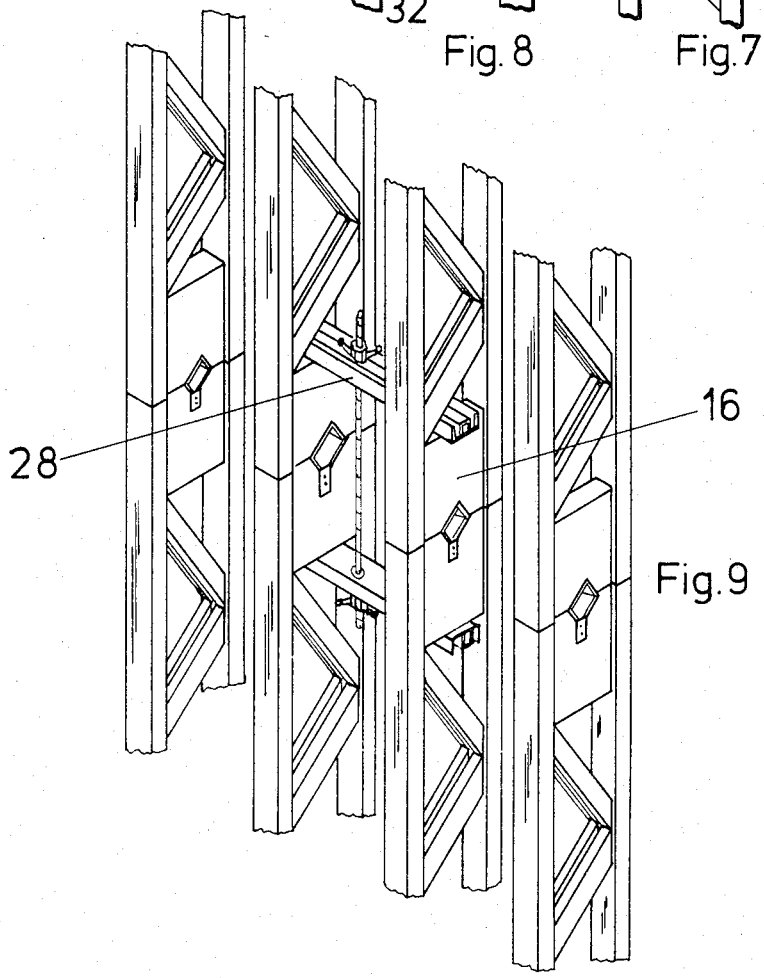
FIG. 9 is a perspective view of several wooden lattice beams erected next to each other with clamps in the neighborhood of the joint.

FIG. 14 illustrates an embodiment in which an extender 34 has been fastened to the end of a wooden lattice beam by the method illustrated in FIGS. 7 through 9. Such an extender, which is as long as one grid field (32 cm for example) is employed when the beam is to be extended only to an extent that does not justify using another beam. By proportioning the individual beams in accordance with an appropriate modulus they can be employed with appropriate extenders to obtain any desired height, which is especially useful with buildings that have stories with very different heights. Extenders 34 are constructed in the form of solid-walled beams that are as wide as the flanges.

The embodiment illustrated in FIGS. 15 and 16 does not require transverse sections 28. The solid web 16 that reinforces the end has a circular central opening 36 into which opens a hole 38 that is drilled along the axis of the bearer through the middle of solid web 16 and that meets another boring 40 through adapter section 20*b*. An unthreaded bolt 42 passes though borings 38 and 40 and is held in place by a cast cup-shaped fastener 44, illustrated by itself in FIG. 16, with a semicircular wall that fits snugly against the wall of circular opening 36 and that is secured with a key 46 that is inserted into a slit in the bolt 42 or tension rod. Bolt 42 can also be threaded and fastener 44 secured with a wing bolt.

As FIG. 14 shows, there is a recess 35 in the rear of extender 34 into which the transverse section 28, which is a double channel section in this case, fits so that it will not project beyond the end of the beam or sheathing element.

Figure 17:
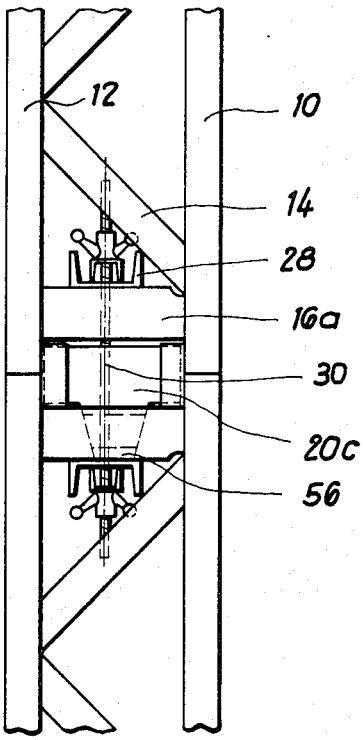
FIG. 17 is a side view of two beams with an adapter section inserted between the top flange, the bottom flange, and the end web, FIG. 18 a view of the beams as in FIG. 17 rotated 90° around their axis, and FIG. 19 a perspective view of the adapter section used in the embodiment shown in FIGS. 17 and 18.
Figure 18:
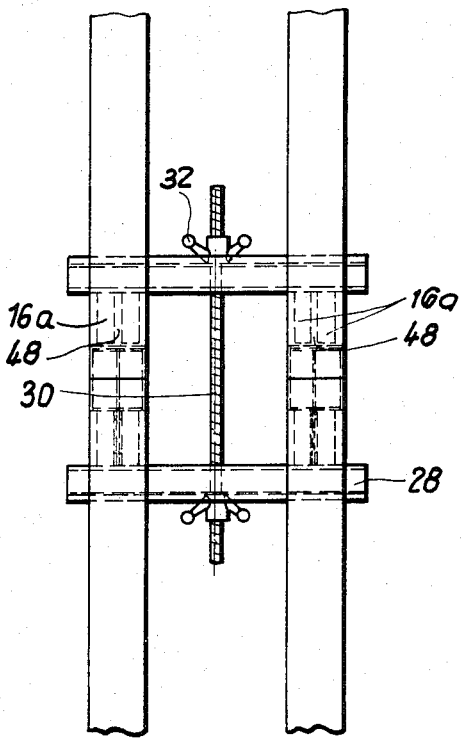
Figure 19:
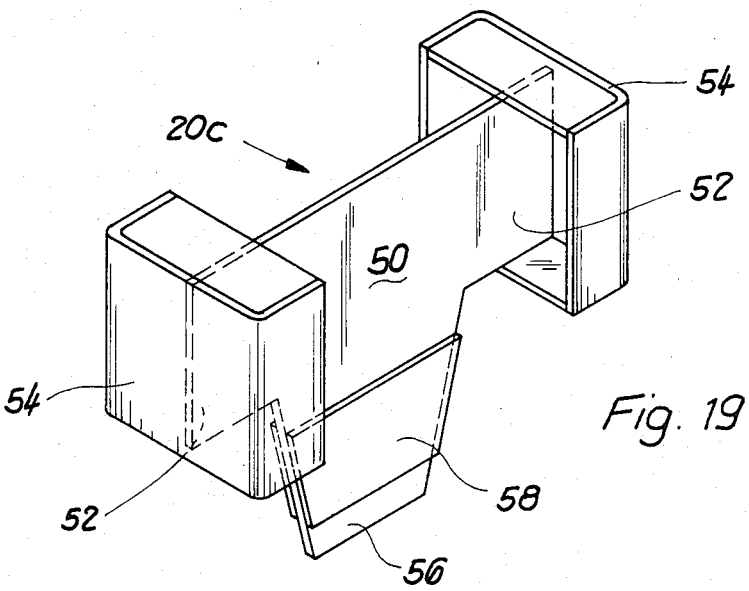

The lattice beams shown in FIGS. 17 and 18 have double webs 16*a* that are recessed into the ends and that have a space 48 between them. The adapter section 20*c* illustrated in FIG. 19 is a T-shaped metal plate 50 with cup-shaped pieces 54 welded to the ends 52 of its cross-piece. These pieces contact the top flange 10, the bottom flange 12, and the butt end of double web 16*a* and provide for transmission of the lateral force. The upright 56 of T-plate 50, which converges toward the bottom, is reinforced with strips 58 of sheet metal and fits into space 48 between double webs 16*a*. When the bearers have been clamped together with bolt 30, nut 32, and transverse sections 28, which rest on the rear of double webs 16*a*, the result is a rigid extended bearer with lateral-force transmission at its joint.

We claim:

1. An assembly of beams wherein each beam comprises:

a first flange extending in one direction; a second flange extending in the one direction, being above and spaced away from the first flange; the flanges having one end; a solid web attached to and extending between the flanges at the one end for holding the flanges in their position; the solid web having a butt end facing outwardly of the one end and the butt end being shaped for flush abutment with the butt end of an adjacent solid web of another of the beams;

a recess defined in the butt end and extending completely across the solid web transversely to a direction between the flanges; the recess being internally geometrically profiled for receiving therein an adapter section of substantial geometric profile;

an adapter section profiled to the internal profile of the recess for being received in the profiled recess; the adapter section extending across the solid web transversely to the direction between the flanges; the adapter section being shaped to project out of the recess and out of the butt end of the solid web for being received in a cooperating profiled recess in an adjacent solid web of an adjacent one of the beams;

and wherein at least one pair of said beams are arranged with their respective butt ends in engagement, and the butt ends being shaped for flush engagement;

the respective recesses in the butt ends being placed to overlie each other when the butt ends are in engagement, and the recesses being identically profiled;

the adapter section being symmetrically shaped, with one symmetrical half of the adapter section being in each of the overlying recesses;

and clamping means for clamping the butt ends of the solid webs into engagement and thereby also for securely clamping the adapter in the overlying recesses;

the said clamping means engaging and squeezing together the solid webs of said butted adjacent beams;

the said beam assemblies being arranged parallel to each other, and the solid webs of the beams of two of the beam assemblies being arrayed along side of each other and spaced apart and the two assemblies being spaced apart; and wherein the clamping means comprises transverse members extending between the solid webs of the two assemblies, whereby the clamping means simultaneously clamp together the solid webs of the two beam assemplies.

2. The assembly of beams of claim 1, wherein an additional clamping means is provided and an additional transverse member is provided; said additional clamping means extending between said additional transverse member and one of said aforementioned transverse members.

3. The assembly of beams of claim 1 wherein said adapter section comprises a T-shaped reinforced plate extending into the said recess.

4. The assembly of beams of claim 3 wherein the ends of the crosspiece of said T carry cup shaped members contacting said flanges for transmission of lateral forces.

5. The beam of claim 1, further comprising a lattice web attached to and extending between the first and second flanges and being away from the one end of the flanges and being next to the solid web for holding the flanges in their positions.

6. The beam of claim 5, wherein the lattice web comprises a series of struts extending diagonally between the first and the second flanges, and a pair of adjacent ones of the struts defines one node division; the beam being of a length measured along the flanges which is an integral multiple of one-half of the length of one node division.

7. The beam assembly of claim 6, wherein the clamping means comprise a respective transversely extending member for engaging each of the solid webs of the two solid webs in the beam assembly, and comprise means for moving the transverse members together, thereby to push the solid webs to be clamped securely.

8. The beam as in claim 7, further comprising bolts that extend through corresponding holes in the transverse member and nuts that are tightened on the bolts.

9. The beam as in claim 8, in which the braces have bolts that extend through a hole parallel to the beam and through the solid web.

10. The beam as in claim 8, further comprising an extender that has a cross-section that corresponds to the cross-section of an end of the solid web and that has an adapter recess in which the length of the extender is equal to the predetermined modulus length.

11. The beam as in claim 10, in which an end of the extender has a recess for receiving a transverse member.

12. The beam of claim 1, wherein the solid web is comprised of wood.

13. The beam of claim 12, wherein the solid web is comprised of boards which are glued together to form the solid web.

14. The beam of claim 12, wherein the solid web comprises a plurality of separated sections thereof, which are spaced apart.

15. The beam of claim 14 in which the solid web comprises a plurality of pieces of solid wood.

16. The beam of claim 1, wherein the recess extends the full distance between the flanges, and the adapter section comprises a plate fitted into and extending over the full distance recess.

17. A beam comprising:

a first flange extending in one direction; a second flange extending in the one direction, being above and spaced away from the first flange; the flanges having one end; a solid web attached to and extending between the flanges at the one end for holding the flanges in their position; the solid web having a butt end facing outwardly of the one end and the butt end being shaped for flush abutment with the butt end of an adjacent solid web of another of the beams;

a recess defined in the butt end and extending completely across the solid web transversely to a direction between the flanges; the recess being internally geometrically profiled for receiving therein an adapter section of substantial geometric profile;

an adapter section profiled to the internal profile of the recess for being received in the profiled recess; the adapter section extending across the solid web transversely to the direction between the flanges; the adapter section being shaped to project out of the recess and out of the butt end of the solid web for being received in a cooperating profiled recess in an adjacent solid web of an adjacent one of the beams;

the said adapter recess extending from the first flange to the second flange, the solid web being recessed from the ends of the beam and the adapter section comprising a web plate with cup-shaped parts on its ends that contact the flanges and solid web.

18. The beam as in claim 17, in which the solid web is designed in the form of a double web and in which the adapter section has at least one ply that fits into the space in the double web.

19. The beam as in claim 18, in which the ply consists of a center portion of a T-shaped web plate.

* * * * *